US012281368B2

(12) United States Patent
Lee et al.

(10) Patent No.: US 12,281,368 B2
(45) Date of Patent: Apr. 22, 2025

(54) WIRE ROD OF WHICH SOFTENING HEAT TREATMENT CAN BE OMITTED, AND MANUFACTURING METHOD THEREFOR

(71) Applicant: POSCO, Pohang-si (KR)

(72) Inventors: Jae-Seung Lee, Pohang-si (KR); Byoung-Gab Lee, Pohang-si (KR); Sang-Yoon Lee, Pohang-si (KR); Se-Hong Min, Pohang-si (KR); Woo-Seok Choi, Pohang-si (KR)

(73) Assignee: POSCO CO., LTD, Gyeongsangbuk-Do Pohang-si (KR)

( * ) Notice: Subject to any disclaimer, the term of this patent is extended or adjusted under 35 U.S.C. 154(b) by 908 days.

(21) Appl. No.: 17/414,063

(22) PCT Filed: Dec. 13, 2019

(86) PCT No.: PCT/KR2019/017687
§ 371 (c)(1),
(2) Date: Jun. 15, 2021

(87) PCT Pub. No.: WO2020/130506
PCT Pub. Date: Jun. 25, 2020

(65) Prior Publication Data

US 2022/0033920 A1 Feb. 3, 2022

(30) Foreign Application Priority Data

Dec. 18, 2018 (KR) ..... 10-2018-0163837

(51) Int. Cl.
*C21D 8/00* (2006.01)
*B21B 1/16* (2006.01)
(Continued)

(52) U.S. Cl.
CPC ..... *C21D 8/065* (2013.01); *B21B 1/16* (2013.01); *C21D 1/32* (2013.01); *C22C 38/02* (2013.01);
(Continued)

(58) Field of Classification Search
CPC .... C21D 8/065; C21D 1/32; C21D 2211/001; C21D 2211/002; C21D 2211/005;
(Continued)

(56) References Cited

U.S. PATENT DOCUMENTS

2014/0326369 A1 11/2014 Yamashita et al.
2015/0041029 A1 2/2015 Yamashita et al.
(Continued)

FOREIGN PATENT DOCUMENTS

CN 101098979 A 1/2008
CN 107923011 A 4/2018
(Continued)

OTHER PUBLICATIONS

Extended European Search Report dated Dec. 22, 2021 issued in European Patent Application No. 19899919.5.
(Continued)

*Primary Examiner* — Anthony M Liang
*Assistant Examiner* — Danny N Kang
(74) *Attorney, Agent, or Firm* — Morgan, Lewis & Bockius LLP

(57) ABSTRACT

The present invention relates to a wire rod of which softening heat treatment can be omitted, and a manufacturing method therefor. One embodiment of the present invention provides a wire rod of which softening heat treatment can be omitted, and a manufacturing method therefor, the wire rod comprising, by wt %, 0.2-0.45% of C, 0.02-0.4% of Si, 0.3-1.5% of Mn, 0.3-1.5% of Cr, 0.02-0.05% of Al, 0.01-0.5% of Mo, 0.01% or less of N, and the balance of Fe and
(Continued)

other inevitable impurities, and having a microstructure consisting of, by area %, 40% or more of proeutectoid ferrite based on an equilibrium phase, 40% or more of regenerated pearlite and bainite, and 20% or less of martensite, and wherein the colony average size of the pearlite in the region amounting to ⅖ to ⅗ of the diameter is 5 μm or less.

7 Claims, 4 Drawing Sheets

(51) Int. Cl.

| | |
|---|---|
| ***C21D 1/32*** | (2006.01) |
| ***C21D 8/06*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |

(52) U.S. Cl.
CPC ..... *C22C 38/04* (2013.01); *C22C 38/06* (2013.01); *C22C 38/22* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C21D 2211/008; C21D 2211/009; C21D 9/52; B21B 1/16; B21B 3/00; B21B 37/74; C22C 38/02; C22C 38/04; C22C 38/06; C22C 38/22; C22C 38/001
See application file for complete search history.

(56) References Cited

U.S. PATENT DOCUMENTS

| | | | |
|---|---|---|---|
| 2018/0251876 | A1 | 9/2018 | Sasaki et al. |
| 2021/0079491 | A1 | 3/2021 | Lee et al. |

FOREIGN PATENT DOCUMENTS

| | | | | |
|---|---|---|---|---|
| EP | 2843070 | A1 | | 3/2015 |
| JP | 2000119809 | A | * | 4/2000 |
| JP | 2000-336456 | A | | 12/2000 |
| JP | 2001-089830 | A | | 4/2001 |
| JP | 2003-183733 | A | | 7/2003 |
| JP | 2004-100016 | A | | 4/2004 |
| JP | 2010-053426 | A | | 3/2010 |
| JP | 5070931 | B2 | | 11/2012 |
| JP | 2013-007090 | A | | 1/2013 |
| JP | 2013-227602 | A | | 11/2013 |
| JP | 2013-234354 | A | | 11/2013 |
| JP | 2015-168882 | A | | 9/2015 |
| KR | 10-2007-0086836 | A | | 8/2007 |
| KR | 10-2014-0095099 | A | | 7/2014 |
| KR | 10-2015-0013246 | A | | 2/2015 |
| KR | 10-1977499 | B1 | | 5/2019 |
| KR | 10-2019-0077772 | A | | 7/2019 |
| KR | 10-2019-0078112 | A | | 7/2019 |
| KR | 10-2065264 | B1 | | 1/2020 |
| KR | 10-2065265 | B1 | | 1/2020 |
| KR | 10-2065266 | B1 | | 1/2020 |
| KR | 10-2020-0049149 | A | | 5/2020 |
| KR | 10-2020-0054420 | A | | 5/2020 |
| KR | 10-2020-0063384 | A | | 6/2020 |
| KR | 10-2020-0063385 | A | | 6/2020 |
| KR | 10-2020-0075305 | A | | 6/2020 |
| WO | 2011/062012 | A1 | | 5/2011 |
| WO | 2016/121820 | A1 | | 8/2016 |

OTHER PUBLICATIONS

International Search Report and Written Opinion issued in corresponding International Application No. PCT/KR2019/017687 dated Mar. 23, 2020, with English translation.
Japanese Office Action dated Sep. 27, 2022 issued in Japanese Patent Application No. 2021-534917.
Chinese Office Action dated May 6, 2022 issued in Chinese Patent Application No. 201980084396.3 (with English translation).

* cited by examiner

【Fig. 1】
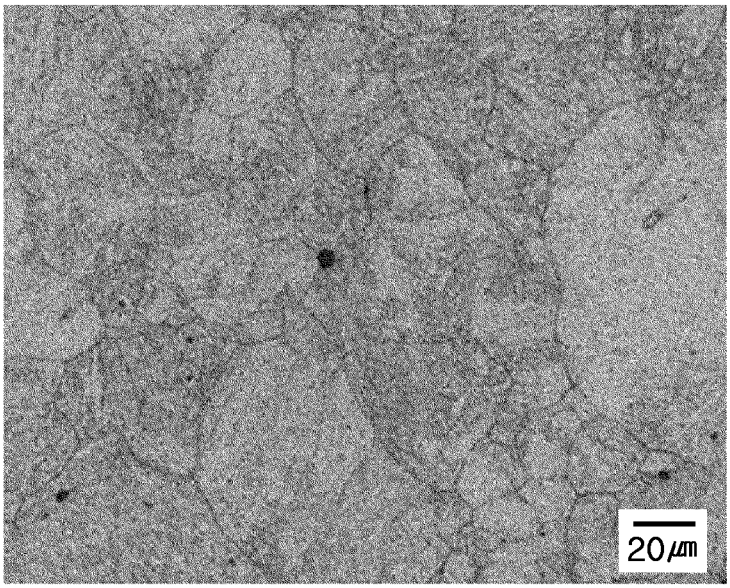
【Fig. 2】
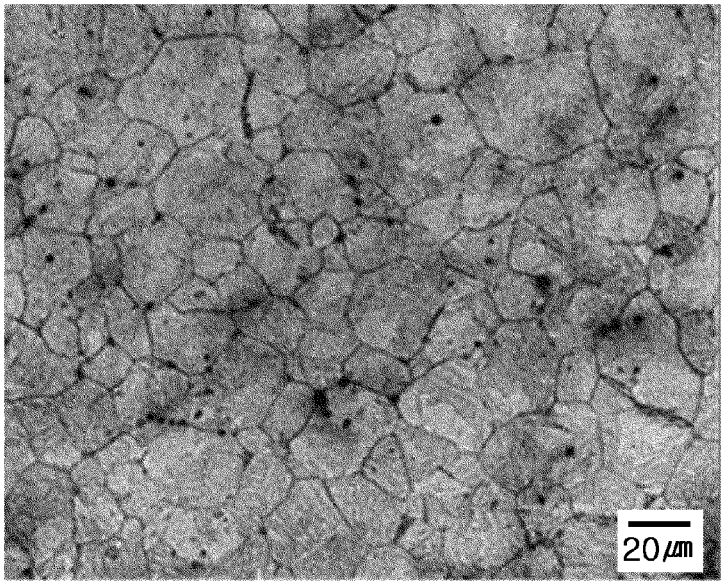

【Fig. 3】
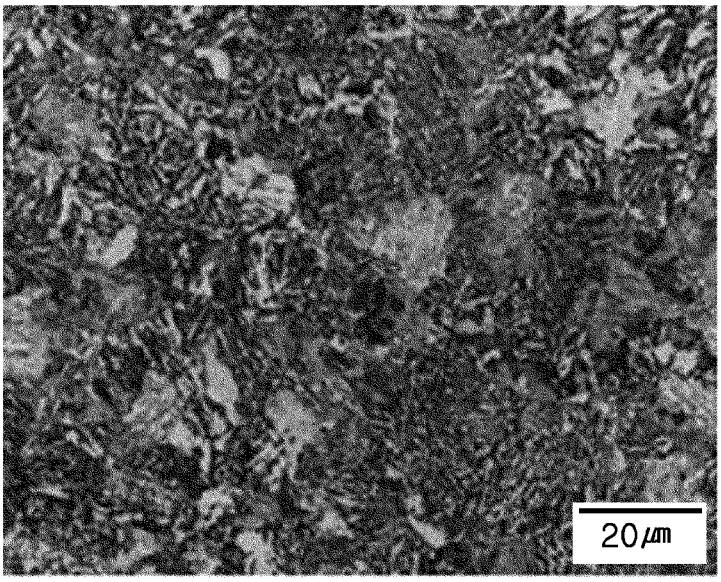
(a)
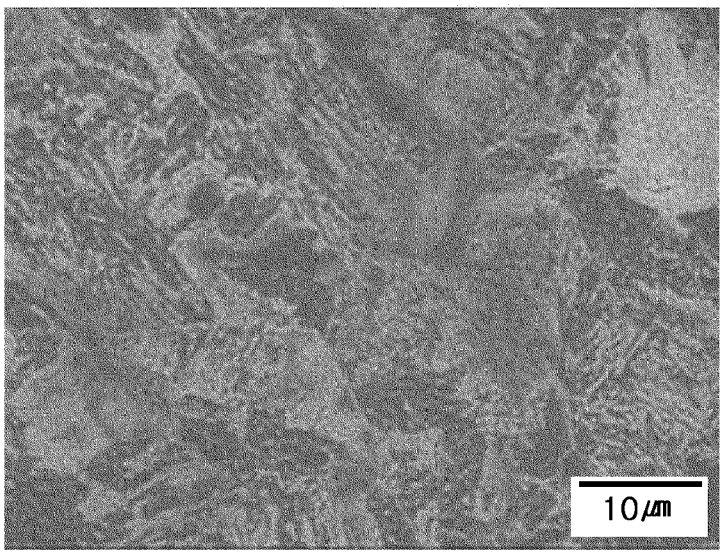
(b)

【Fig. 4】
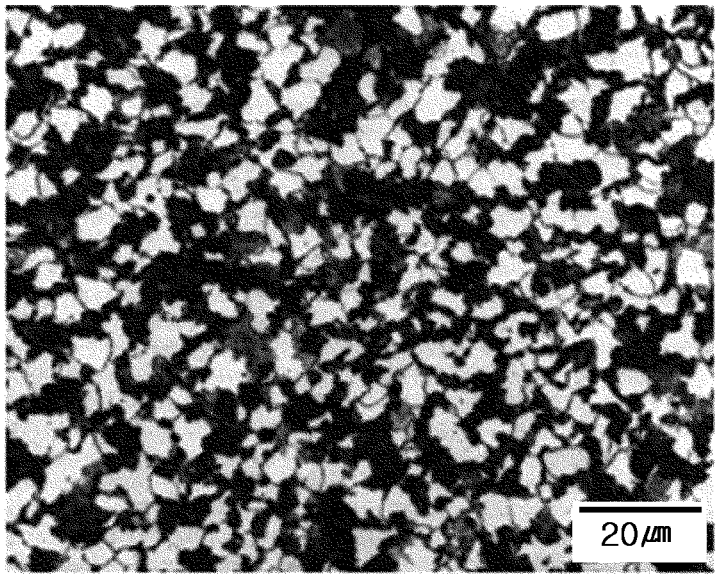
(a)
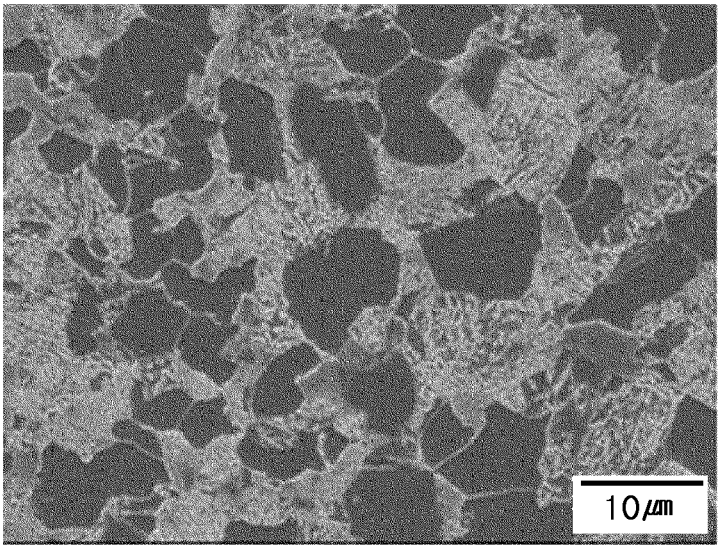
(b)

【Fig. 5】
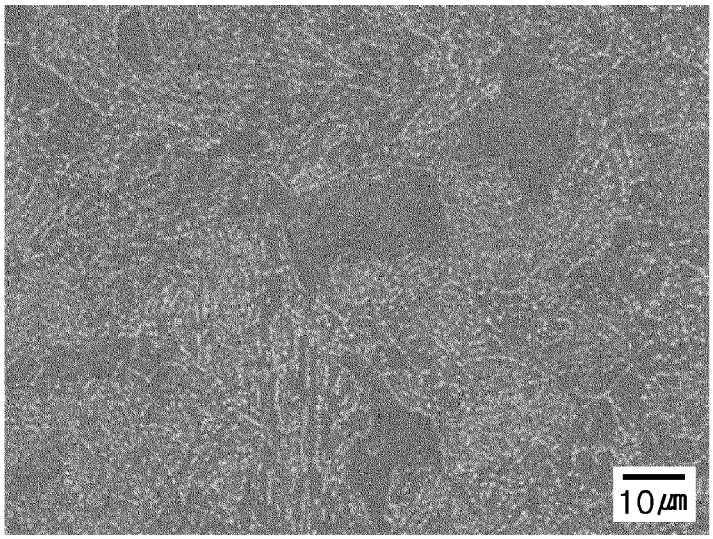
【Fig. 6】
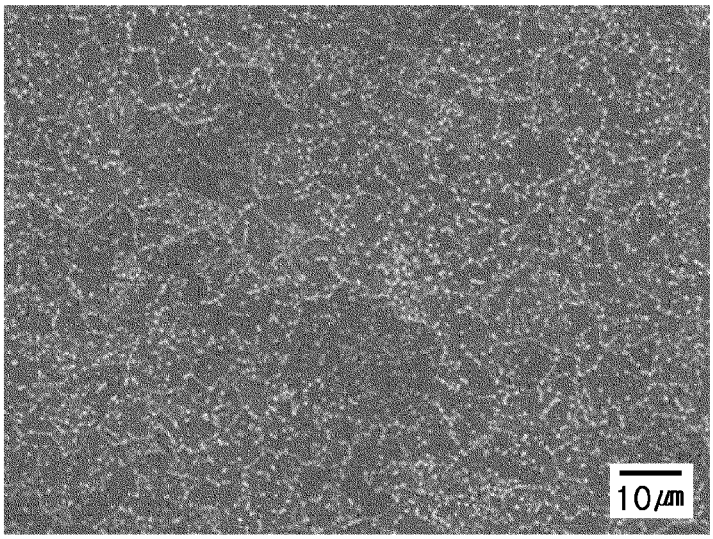

WIRE ROD OF WHICH SOFTENING HEAT TREATMENT CAN BE OMITTED, AND MANUFACTURING METHOD THEREFOR

CROSS REFERENCE

This application is the U.S. National Phase under 35 U.S.C. § 371 of International Application No. PCT/KR2019/017687 filed on Dec. 13, 2019, which claims the benefit of Korean Application No. 10-2018-0163837 filed on Dec. 18, 2018, the entire contents of each are hereby incorporated by reference.

TECHNICAL FIELD

The present disclosure relates to a wire rod allowing a softening heat treatment to be omitted and a method of manufacturing the same, and more particularly, to a wire rod for a mechanical structure which may be applied to vehicle, construction components, and the like, and a method of manufacturing the same.

BACKGROUND ART

Generally, for softening of a material for cold processing, a lengthy heat treatment of 10 to 20 hours or more at a high temperature of 600 to 800° C. may be required, and many techniques have been developed to shorten or omit the treatment.

Patent Document 1 may be a representative technique. The purpose of the above technique is to, by refining grains by controlling a ferrite grain size to be 11 or more and controlling 3-15% of a hard plate-shaped cementite phase in a pearlite structure to have a segmented form, omit a subsequently performed softening heat treatment. However, to manufacture such a material, a cooling rate in cooling after hot-rolling may need to be extremely low, 0.02 to 0.3° C./sec. The slow cooling rate may be accompanied by a decrease in productivity, and a separate slow cooling facility and a slow cooling yard may be necessary depending on an environment.

(Patent Document 1)

Japanese Laid-Open Patent Publication No. 2000-336456

DISCLOSURE

Technical Problem

An aspect of the present disclosure is to provide a steel wire rod enabling the omission of a softening heat treatment needed in cold processing of vehicle, construction components, and the like, and a method of manufacturing the same.

Technical Solution

According to an aspect of the present disclosure, a wire rod, allowing a softening heat treatment to be omitted, is provided. The wire rod includes, by weight %, 0.2 to 0.45% of carbon (C), 0.02 to 0.4% of silicon (Si), 0.3 to 1.5% of manganese (Mn), 0.3 to 1.5% of chromium (Cr), 0.02 to 0.05% of aluminum (Al), 0.01 to 0.5% of molybdenum (Mo), 0.01% or less of nitrogen (N), and a balance of iron (Fe) and inevitable impurities, wherein the wire rod has a microstructure consisting of, by area %, 40% or more of proeutectoid ferrite based on an equilibrium phase, 40% or more of regenerated pearlite and bainite, and 20% or less of martensite, and wherein an average colony size of the pearlite in a region from a ⅖ point to a ⅗ point of a diameter, from a surface of the wire rod, is 5 μm or less.

According to another aspect of the present disclosure, a method of manufacturing a wire rod, allowing a softening heat treatment to be omitted, is provided. The method includes: heating a billet at a temperature within a range of 950 to 1050° C., the billet comprising, by weight %, 0.2 to 0.45% of carbon (C), 0.02 to 0.4% of silicon (Si), 0.3 to 1.5% of manganese (Mn), 0.3 to 1.5% of chromium (Cr), 0.02 to 0.05% of aluminum (Al), 0.01 to 0.5% of molybdenum (Mo), 0.01% or less of nitrogen (N), and a balance of iron (Fe) and inevitable impurities; performing two step hot rolling on the heated billet to obtain a rod wire; coiling the rod wire; and cooling the coiled rod wire to 600° C. at a cooling rate of 2° C./sec, and then cooling the cooled rod wire at a cooling rate of 3° C./sec, wherein the performing of the two step hot rolling comprises: performing intermediate finish rolling on the heated billet; and performing finish rolling at a temperature of 730° C. to Ae3 with a critical deformation amount or more expressed by the following Relational Expression 1.

$$\text{Critical Deformation Amount} = -2.46Ceq^2 + 3.11Ceq - 0.39$$

(Ceq=C+Mn/6+Cr/5, and C, Mn, and Cr are weight %) [Relational Expression 1]

Advantageous Effects

According to an aspect of the present disclosure, a steel wire rod allowing a softening heat treatment to be omitted needed in cold processing of vehicle, construction components, and the like, and a method of manufacturing same may be provided.

DESCRIPTION OF DRAWINGS

FIG. 1 is an image of a microstructure before finishing hot-rolling in Comparative Example 1, obtained using an optical microscope.

FIG. 2 is an image of a microstructure before finishing hot-rolling in Inventive Example 1, obtained using an optical microscope.

FIG. 3 is an image of a microstructure after rolling and cooling in Comparative Example 1, in which (a) is an image obtained using an optical microscope and (b) is an image obtained using a scanning electron microscope (SEM).

FIG. 4 is an image of a microstructure after rolling and cooling in Inventive Example 1, in which (a) is an image obtained using an optical microscope and (b) is an image obtained using an SEM.

FIG. 5 is an image of a microstructure after a spheroidizing heat treatment in Comparative Example 1, obtained using an SEM.

FIG. 6 is an image of a microstructure after a spheroidizing heat treatment in Inventive Example 1, obtained using an SEM.

BEST MODE FOR INVENTION

Hereinafter, a wire rod allowing a softening heat treatment to be omitted according to an embodiment of the present disclosure will be described. First, an alloy composition of the present disclosure will be described. The content of the alloy composition described below is represented by weight % unless otherwise indicated.

Carbon (C): 0.2 to 0.45%

Carbon (C) may be added to secure a certain level of strength. When the content of carbon is greater than 0.45%, the entire structure may be formed of pearlite, such that it may be difficult to secure a ferrite structure in which the purpose of the present disclosure, and hardenability may excessively increase such that it may be highly likely that a hard low-temperature transformation structure may be formed in an amount. When the content is less than 0.2%, strength of a base material may degrade such that it may be difficult to secure sufficient strength after quenching and tempering heat treatment performed after softening heat treatment and a forging process. Therefore, preferably, the content of C may have a range of 0.2 to 0.45%. A lower limit of the content of carbon may be, in detail, 0.22%, in further detail, 0.24%, and, in yet further detail, 0.26%. An upper limit of the content of carbon may be more preferably 0.43%, even more preferably 0.41%, and most preferably 0.39%.

Silicon (Si): 0.02 to 0.4%

Silicon (Si) may be a representative substitutional element and may be added to secure a certain level of strength. When the amount of silicon is less than 0.02%, it may be difficult to secure strength of steel and sufficient hardenability. When the content of silicon is greater than 0.4%, cold forgeability may be deteriorated during forging after softening heat treatment. Therefore, the content of silicon may have a range of, in detail, 0.02 to 0.4%. A lower limit of the content of silicon may be, in detail, 0.022%, in further detail, 0.024%, and, in yet further detail, 0.026%. An upper limit of the content of silicon may be, in detail, 0.038%, in further detail, 0.036%, and, in yet further detail, 0.034%.

Manganese (Mn): 0.3 to 1.5%

Manganese (Mn) may form a substitution type solid solution in a matrix structure, and may lower a temperature Al such that an interlayer spacing of pearlite may be refined, and may increase subcrystal grains in a ferrite structure. When the content of manganese is greater than 1.5%, a harmful effect may occur due to structure heterogeneity caused by manganese segregation. When steel is solidified, macrosegregation and microsegregation may be likely to occur depending on a segregation mechanism, and manganese may promote segregation due to a relatively low diffusion coefficient as compared with other elements, and improvement of hardenability caused thereby may be a main cause of creating a low-temperature structure such as martensite in the central region. When the content of manganese is less than 0.3%, it may be difficult to secure sufficient hardenability for securing a martensite structure after quenching and tempering heat treatment performed after the softening heat treatment and a forging process. Therefore, the content of manganese may have a range of, in detail, 0.3 to 1.5%. A lower limit of the content of manganese may be, in detail, 0.4%, in further detail, 0.5%, and, in yet further detail, 0.6%. An upper limit of the content of manganese may be, in detail, 1.4%, in further detail, 1.3%, and, in yet further detail, 1.2%.

Chromium (Cr): 0.3 to 1.5%

Similarly to manganese, chromium may be mainly used as an element for enhancing hardenability of steel. When the content of chromium is less than 0.3%, it may be difficult to secure sufficient hardenability for obtaining martensite during quenching and tempering heat treatment performed after a softening heat treatment and a forging process. When the content of chromium is greater than 1.5%, central segregation may be promoted such that it may be highly likely that an amount of low-temperature structure may be formed in the wire rod. Therefore, the content of chromium may have a range of 0.03 to 1.5%. A lower limit of the content of chromium may be, in detail, 0.4%, in further detail, 0.5%, and, in yet further detail, 0.6%. An upper limit of the content of chromium may be, in detail, 1.4%, in further detail, 1.3%, and, in yet further detail, 1.2%.

Aluminum (Al): 0.02 to 0.05%

Aluminum may have a deoxidation effect, and may precipitate aluminum-based carbonitride such that austenite grain growth may be inhibited and a fraction of proeutectoid ferrite may be secured close to an equilibrium phase. When the content of aluminum is less than 0.02%, the deoxidation effect may be insufficient. When the content of aluminum is greater than 0.05%, hard inclusions such as $Al_2O_3$ etc. may increase and, in particular, nozzle clogging may occur due to the inclusions during continuous casting. Therefore, the content of aluminum may have a range of, in detail, 0.02 to 0.05%. A lower limit of the content of aluminum may be, in detail, 0.022%, in further detail, 0.024%, and, in yet further detail, 0.026%. An upper limit of the content of aluminum may be, in detail, 0.048%, in further detail, 0.046%, and, in yet further detail, 0.044%.

Molybdenum (Mo): 0.01 to 0.5%

Molybdenum (Mo) may precipitate a molybdenum-based carbonitride such that austenite grain growth is inhibited, and may contribute to forming of proeutectoid ferrite. Also, molybdenum may form $Mo_2C$ precipitates during tempering in a quenching and tempering heat treatment performed after a softening heat treatment and forging process, such that may be effective in inhibiting strength degradation (temper softening). When the content of molybdenum is less than 0.01%, it may be difficult to have a sufficient effect of inhibiting strength degradation. When the content of molybdenum is greater than 0.5%, a large number of low-temperature structures may be formed in the wire rod, so that additional heat treatment costs for removing the low-temperature structure may be incurred. Therefore, the content of molybdenum may have a range of, in detail, 0.01 to 0.5%. A lower limit of the content of molybdenum may be, in detail, 0.012%, in further detail, 0.013%, and, in yet further detail, 0.014%. An upper limit of the content of molybdenum may be, in detail, 0.49%, in further detail, 0.48%, and, in yet further detail, 0.47%.

Nitrogen (N): 0.01% or Less

Nitrogen (N) may be one of impurities. When the content of nitrogen is greater than 0.01%, material toughness and ductility may be deteriorated due to solute nitrogen not combined as a precipitate. Therefore, the content of nitrogen may have a range of, in detail, 0.01% or less. The content of nitrogen may be, in detail, 0.019% or less, in further detail, 0.018% or less, and, in yet further detail, 0.017% or less.

A balance of the present disclosure may be iron (Fe). However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure.

A wire rod of the present disclosure may have a microstructure consisting of, by area %, 40% or more of proeutectoid ferrite based on an equilibrium phase, 40% or more of regenerated pearlite and bainite, and 20% or less of martensite. The proeutectoid ferrite is a soft phase and has a main effect of a decrease in strength of a material. When a fraction of the proeutectoid ferrite is less than 40% based on the equilibrium phase, it may be difficult to effectively secure a spheroidizing heat treatment property as a relatively large amount of a hard phase is formed. It is desirable that the fraction of the proeutectoid ferrite based on the equilibrium phase may be 80% or less. When the fraction of the proeutectoid ferrite is greater than 80% of the equilibrium phase, a significantly low cooling rate may be required to result in reduced productivity. The equilibrium phase of the proeutectoid ferrite may refer to a maximum fraction of proeutectoid ferrite which may be in a stable state on the $Fe_3C$ phase diagram. The equilibrium phase of the proeutectoid ferrite can be easily derived by a person of ordinary skill in the art in consideration of the content of carbon and the content of other alloying elements through the $Fe_3C$ phase diagram. The regenerated pearlite and bainite include ferrite and cementite, and the regenerated pearlite refers to a structure having segmented cementite while having a high dislocation density due to a rolling or drawing process. For example, unlike plate-shaped cementite which is generally present in a pearlite structure, the regenerated pearlite may have a discontinuous and segmented cementite distribution to achieve spheroidization at high speed during a spheroidizing soft heat treatment. To obtain the above effect, a fraction of the recycled pearlite and bainite may be 40% or more. On the other hand, a fraction of the regenerated pearlite and bainite may be 80% or less. When the fraction of the regenerated pearlite and bainite is greater than 80%, a spheroidized carbide may be refined, such that a sufficient decrease in strength may not may not occur. The martensite is a hard phase and has an effect of forming a spheroidized carbide rapidly for a short period of time. However, when the fraction of martensite is greater than 20%, an effect of increasing the strength may occur due to a fine carbide. The fraction of martensite may be 3% or more. When the fraction of martensite is less than 3%, spheroidized carbide seeds may be decreased at an initial time of a heat treatment, such that spheroidization may be delayed.

In the wire rod of the present disclosure, an average colony size of pearlite in a region of ⅖ point to ⅗ point of a diameter may be 5 μm or less. As described above, the average colony size of pearlite may be controlled to be refined, and thus, a segmentation effect of cementite may be improved to increase a spheroidizing rate of cementite during a spheroidizing heat treatment.

In addition, an average grain size of the proeutectoid ferrite in the region of the ⅖ point to ⅗ point of the diameter may be 7 μm or less. As described above, the average grain size of ferrite may be controlled to be refined, and thus, a colony size of pearlite may also be refined to increase a spheroidization rate of cementite the during spheroidization heat treatment.

In addition, an average major-axis size of cementite in the pearlite colony may be 5 μm or less. As described above, the average major-axis size of cementite in the pearlite colony may be controlled to small, for example, an aspect ratio of cementite may be controlled to be small, and thus, a spheroidization rate of cementite may be increased during the spheroidization heat treatment.

Meanwhile, in the present disclosure, the average colony size of the pearlite, the average grain size of the proeutectoid ferrite, and the average major-axis size of the cementite in the pearlite colony may be those in a diameter-based central portion, for example, a region of ⅖ point to ⅗ point from a surface of the wire rod based on a diameter of the wire rod. In general, since a surface layer portion of the wire rod receives a strong rolling force during rolling, an average colony size of pearlite, an average grain size of proeutectoid ferrite, and an average major-axis size of cementite in pearlite colony may be fine. However, in the present disclosure, an average colony size of the pearlite and an average grain size of the ferrite in the central portion as well as the surface layer portion of the wire rod may be refined to effectively increase a spheroidization rate of the cementite during the spheroidization heat treatment.

For example, in the wire rod of the present disclosure, a deviation between an average grain size of the proeutectoid ferrite in a region from the surface of the wire rod to a ⅕ point of the diameter and an average grain size of the proeutectoid ferrite in a region from a ⅖ point to a ⅗ point of the diameter may be 6 μm or less.

The wire rod according to the present disclosure may have a tensile strength TS of 579+864×([C]+[Si]/8+[Mn]/18) MPa or more. According to the present disclosure, strength of steel may be increased due to fine ferrite grains in spite of a high fraction of ferrite. The tensile strength of the wire rod according to the present disclosure may have the same relation as described in the above equation. The phrase "having the above strength while having a ferrite fraction" means that ferrite grains of the steel are significantly fine, and grain refinement of the steel may be confirmed only by a tensile test performed in the field without separate observation of a microstructure. Since the wire rod according to the present disclosure has the above-described tensile strength, it may be easy to secure strength of the wire rod itself and a softening heat treatment process may be omitted or reduced during a subsequent softening heat treatment.

In general, to manufacture a steel wire rod into a steel wire, a first softening heat treatment→first wire drawing→a second softening heat treatment→second wire drawing may be performed. However, as for the steel wire rod of the present disclosure, processes corresponding to the first soft softening heat treatment and the first wire drawing may be omitted through sufficient softening of the material. The softening heat treatment mentioned in the present disclosure may include a low-temperature annealing heat treatment performed at an Ae1 phase transformation point or less, a medium temperature annealing heat treatment performed at around Ae1, and a spheroidizing annealing heat treatment performed Ae1 or more.

In addition, the steel wire rod according to the present disclosure may have an average aspect ratio of cementite of 2.5 or less after a spheroidizing annealing heat treatment performed once. In general, it is widely known that the spheroidizing annealing heat treatment may be effective in spheroidizing of cementite as the number of performing the treatment increases. However, in the present disclosure, cementite may be sufficiently spheroidized by only performing the spheroidizing annealing heat treatment once. As mentioned above, since the surface layer of the steel wire rod receives strong rolling force during rolling, the spheroidization of cementite may also be smoothly performed. However, in the present disclosure, cementite in a diameter-based central portion of the steel wire rod in a region of ¼ point to ½ point from a diameter-based surface, for example, may be sufficiently spheroidized, so that an average aspect ratio of cementite in the central portion of the steel wire rod may be 2.5 or less. In addition, the steel wire rod according to the present disclosure may have tensile strength of 540 MPa or less after the spheroidization heat treatment performed once. Accordingly, cold-rolling or cold-forging processing for manufacturing an end product may be easily performed.

Hereinafter, a method of manufacturing a wire rod, allowing a softening heat treatment to be omitted, according to an embodiment of the present disclosure will be omitted will be described.

First, a billet having the above-described alloy composition may be heated at a temperature of 950 to 1050° C. When the billet heating temperature is less than 950° C., rollability may be decreased. When billet heating temperature is greater than 1050° C., quenching may be required for rolling. Therefore, it may be difficult to control the cooling and cracking, or the like, may occur and, accordingly, it may be difficult to secure excellent product quality.

The heating time during the heating may be 90 minutes or less. When the heating time exceeds 90 minutes, a depth of a surface decarburization layer may be increased to cause a decarburization layer to remain after the rolling is completed.

Then, the heated billet may be subjected to two step hot rolling to obtain a wire rod. The two step hot rolling may be, in detail, groove rolling in which the billet has a shape of a wire rod. The two step hot rolling may include an operation of performing intermediate finish rolling on the heated billet and performing finish rolling on the heated billet at a temperature of 730° C. to Ae3 with a critical deformation amount or more expressed by the following Relational Expression 1.

$$\text{Critical Deformation Amount} = -2.46Ceq^2 + 3.11Ceq - 0.39$$

(Ceq=C+Mn/6+Cr/5, and C, Mn, and Cr are weight %) [Relational Expression 1]

Wire rod rolling speed may be significantly high, and thus, may belong to a dynamic recrystallization region. Research results up to date have indicated that an austenite grain size may depend only on a deformation rate and a deformation temperature under dynamic recrystallization conditions. Due to characteristics of wire rod rolling, when a wire diameter is determined, the amount of deformation and the deformation rate may be determined, and the austenite grain size may be changed by adjusting the deformation temperature. In the present disclosure, during dynamic recrystallization, grains may be refined using a dynamic deformation organic transformation phenomenon. To secure the microstructure grains to be obtained in the present disclosure using the phenomenon, it may be preferable to control the finishing rolling temperature to be 730° C.-Ae3. When the finish rolling temperature exceeds Ae3, it may be difficult to obtain microstructure grains to be obtained in the present disclosure such that it may be difficult to obtain sufficient spheroidizing heat treatment properties. When the temperature is less than 730° C., an equipment load may be increased to rapidly reduce equipment lifespan.

In addition, when the finish rolling is performed with less than the critical deformation amount expressed by the above Relational Expression 1, a reduction amount may be insufficient, so that it may be difficult to sufficiently refine an average aspect ratio of cementite and an average grain size of ferrite in a central portion of the wire rod, and spheroidization heat treatment properties of the steel rod wire obtained therefrom may be deteriorated.

In this case, an average surface temperature $T_{pf}$ of the wire rod before the finish rolling and an average surface temperature $T_f$ of the wire rod after the finish rolling may satisfy, in detail, the following Relational Expression 1. When the average surface temperature $T_{pf}$ of the rod wire before the finish rolling and the average surface temperature $T_f$ of the rod wire after the finish finishing rolling do not satisfy the following Relational Expression 1, a deviation of the microstructure may be significantly increased and surface sub-cooling may be increased, so that a large amount of a hard phase may be formed.

$$T_{pf} - T_f \leq 50° \text{ C.} \quad \text{[Relational Expression 1]}$$

After the intermediate finish rolling, an average grain size of austenite of the wire rod may be, in detail, 5 to 20 μm. Ferrite is known to be grown by nucleating in grain boundaries of austenite. When grains of austenite, a parent phase, are fine, ferrite nucleating in the grain boundaries may also start to be fine. Therefore, a ferrite grain refinement effect may be obtained by controlling the average grain size of austenite of the wire rod after intermediate finish rolling as described above. When the average grain size of the austenite is greater than 20 μm, it may be difficult to obtain the ferrite grain refinement effect. To obtain an average grain size of the austenite which is less than 5 μm, a separate facility may be required to additionally apply a high deformation amount such as strong reduction.

The coiled rod wire may be cooled to 600° C. at a cooling rate of 2° C./sec or less, and then cooled at a cooling rate of 3° C./sec or more. When the cooling rate to 600° C. is greater than 2° C./sec, a large amount of hard phase such as martensite may be generated. Meanwhile, the cooling rate to 600° C. may be, in detail, 0.5 to 2° C./sec in terms of refinement of ferrite grains. Then, a temperature range of less than 600° C. may be quenched at a cooling rate of, in detail, 3° C./sec or more. Through the above-mentioned quenching, a regenerated pearlite and bainite structure, a semi-hard phase, and a martensite structure, a hard phase, may be secured at an appropriate fraction to be obtained by the present disclosure, and growth of plate-shaped cementite, disadvantageous to the spheroidizing heat treatment, may be suppressed.

Thereafter, the wire rod may be coiled to manufacture a wire rod.

In this case, an average surface temperature $T_f$ and a coiling temperature $T_1$ of the wire rod after the finish rolling may satisfy, in detail, the following Relational Expression 2. When the average surface temperature $T_f$ and the coiling temperature $T_1$ of the wire rod after the finish rolling do not satisfy the following Relational Expression 2, a deviation of the microstructure may be significantly increased and surface sub-cooling may be increased, so that a large amount of hard phase may be formed.

$$t_f - T_1 \leq 30° \text{ C.} \quad \text{[Relational Expression 2]}$$

In the present disclosure, after the coiling, the method further include performing a spheroidizing heat treatment in which the wire rod is heated to Ae1 to Ae1+40° C. and held for 10 to 15 hours, and then cooled to 660° C. at 20° C./hr or less. When the heating temperature is less than Ae1, a spheroidizing heat treatment time may be prolonged. When the temperature is greater than Ae1+40° C., the spheroidizing carbide seeds may be reduced to result in an insufficient spheroidizing heat treatment effect. When the holding time is less than 10 hours, the spheroidizing heat treatment may be insufficiently performed to increase an aspect ratio of cementite. When the cooling rate is greater than 20° C./hr, pearlite may be formed again due to the high cooling rate. As mentioned above, in the present disclosure, even when only the spheroidizing heat treatment is performed without the first softening heat treatment and the first wire drawing, sufficient spheroidizing heat treatment properties may be secured.

BEST MODE FOR INVENTION

Hereinafter, the present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

Example

A billet having an alloy composition of the following Table 1 was prepared, and then a wire rod having a diameter of 10 mm was manufactured using conditions listed in the following Tables 2 and 3. As for the manufactured wire rod, a microstructure, an average grain size of proeutectoid ferrite, an average colony size of pearlite, an average major-axis size of cementite in a pearlite colony, and a deviation in average grain sizes of proeutectoid ferrite of a surface layer portion and a central portion were measured and results thereof are listed in the following Table 3. In addition, the wire rod was subjected to spheroidization heat treatment once under conditions of the following Table 4, and then an average aspect ratio and tensile strength of cementite were measured, and results thereof are listed in Table 4. In this case, the spheroidizing heat treatment was performed without performing a first softening treatment and a first wire drawing process on specimens of the manufactured wire rod.

An average grain size (AGS) of austenite was measured through shear cropping performed before finishing hot-rolling.

Ae1 and Ae3 represented values calculated using JmatPro, a commercial program.

As for the average grain size (FGS) of proeutectoid ferrite, the steel rod wire was rolled using an ASTM E112 method, a non-water cooling portion was removed, and three arbitrary points in a region of ⅖ point to ⅗ point from the diameter of the obtained specimen were measured, and an average value thereof was calculated.

As for the average colony size of pearlite, ten arbitrary pearlite colonies were selected from the same point as in the FGS measurement using an ASTM E112 method, a (major axis+minor axis)/2 value of each colony was obtained, and an average value of colony sizes was obtained.

The deviation in average grain sizes of proeutectoid ferrite of a surface layer portion and a central portion was calculated after measuring an average size of proeutectoid ferrite grains in the surface layer and the central portion in a region from the surface to a ⅕ point of the diameter and an average size of proeutectoid ferrite grains in the surface layer and the central portion in a region from a ⅖ point to a ⅗ point of the diameter using the ASTM E112 method.

As for the average aspect ratio of cementite after the spheroidizing heat treatment, three fields of view of 2000 times SEM of ¼ to ½ point was imaged in a direction of a diameter of the steel rod wire, and a major axis/minor axis of cementite in the field of view were automatically measured using an image measurement program, and then was statistically processed.

TABLE 1

| | Alloy Composition (wt %) | | | | | | |
|---|---|---|---|---|---|---|---|
| | C | Si | Mn | Cr | No | Al | N |
| CS 1 | 0.35 | 0.30 | 1.30 | 1.0 | 0.6 | 0.03 | 0.0020 |
| IS 1 | 0.35 | 0.30 | 1.30 | 0.9 | 0.3 | 0.03 | 0.0025 |
| IS 2 | 0.40 | 0.20 | 1.20 | 1.1 | 0.4 | 0.04 | 0.0035 |
| IS 3 | 0.30 | 0.30 | 0.80 | 0.8 | 0.2 | 0.04 | 0.0024 |
| IS 4 | 0.35 | 0.20 | 0.70 | 1.0 | 0.2 | 0.03 | 0.0034 |
| IS 5 | 0.40 | 0.25 | 0.80 | 0.9 | 0.15 | 0.03 | 0.0025 |
| IS 6 | 0.35 | 0.30 | 1.20 | 1.1 | 0.2 | 0.03 | 0.0022 |
| IS 7 | 0.35 | 0.18 | 1.20 | 1.15 | 0.3 | 0.04 | 0.0033 |
| IS 8 | 0.30 | 0.15 | 1.40 | 0.8 | 0.3 | 0.03 | 0.0025 |

CS: Comparative Steel

IS: Inventive Steel

TABLE 2

| | Steel Type No. | HTemp (° C.) | HTime (min) | MGS after IFR (μm) | Ae3 (° C.) | FRTemp (° C.) | RE1 | DA | $T_{Bf}$ − $T_f$ | $T_f$ − $T_1$ |
|---|---|---|---|---|---|---|---|---|---|---|
| CE 1 | CS 1 | 1000 | 90 | 15 | 780.6 | 780 | 0.55 | 1 | 44 | 42 |
| CE 2 | IS 1 | 950 | 80 | 11 | 777.7 | 850 | 0.56 | 0.6 | 63 | 23 |
| CE 3 | IS 2 | 1020 | 90 | 15 | 777.1 | 780 | 0.51 | 0.2 | 80 | 21 |
| CE 4 | IS 3 | 1000 | 90 | 13 | 803.6 | 770 | 0.59 | 1 | 55 | 32 |
| IF 1 | IS 4 | 950 | 90 | 10 | 789.2 | 760 | 0.59 | 1.2 | 40 | 24 |
| IF 2 | IS 5 | 1000 | 80 | 11 | 778.7 | 750 | 0.58 | 0.8 | 38 | 21 |
| IF 3 | IS 6 | 1020 | 90 | 9 | 779.7 | 730 | 0.55 | 0.6 | 43 | 18 |
| IF 4 | IS 7 | 990 | 90 | 9 | 778.2 | 760 | 0.54 | 0.8 | 37 | 24 |
| IF 5 | IS 8 | 1020 | 90 | 10 | 784.3 | 750 | 0.58 | 1 | 44 | 21 |

[Relational Expression 1] Critical Deformation Amount = $-2.46Ceq^2 + 3.11Ceq - 0.39$ (Ceq = C + Mn/6 + Cr/5, and C, Mn, Cr are weight %)

$T_{Bf}$: average surface temperature of rod wire after finish rolling $T_f$: average surface temperature of rod wire after finish rolling $T_f$: average surface temperature of rod wire after finish rolling $T_1$: coiling temperature CE: Comparative Example IE: Inventive Example CS: Comparative Steel IS: Inventive Steel HTemp: Heating Temperature HTime: Heating Time AGS after IFR: Average Grain Size after Intermediate Finish Rolling FRTemp: Finish Rolling Temperature RE1: Relational Expression 1

DA: Deformation Amount

TABLE 3

| | CR to 600° C. (° C./s) | CR after 600° C. (° C./s) | Microstructure (area %) EP F | F | P + B | M | P ACS (μm) | F AGS (μm) | P AMAS CC (μm) | D in F-AGS (μm) | TS (MPa) |
|---|---|---|---|---|---|---|---|---|---|---|---|
| CE 1 | 4 | 4 | 50 | 20 | 40 | 40 | 10 | 10 | 9 | 9.2 | 1050 |
| CE 2 | 1.5 | 3 | 50 | 30 | 40 | 30 | 13 | 12 | 11 | 7.9 | 990 |
| CE 3 | 2 | 3.5 | 40 | 25 | 45 | 30 | 12 | 15 | 10 | 7.4 | 850 |
| CE 4 | 2 | 2 | 60 | 45 | 40 | 15 | 15 | 12 | 15 | 10.1 | 745 |
| IE 1 | 2 | 3 | 50 | 30 | 55 | 15 | 3 | 3 | 3.5 | 4.4 | 980 |
| IE 2 | 1 | 3.5 | 40 | 32 | 58 | 10 | 3 | 4 | 3.4 | 3.2 | 1030 |
| IE 3 | 1 | 4 | 50 | 35 | 53 | 12 | 5 | 6 | 4.3 | 3.8 | 990 |
| IE 4 | 1.5 | 3 | 50 | 37 | 56 | 7 | 3.2 | 2.8 | 3 | 3.4 | 1030 |
| IE 5 | 2 | 3.5 | 60 | 38 | 55 | 7 | 4.2 | 4.5 | 4 | 3.8 | 1020 |

F: Proeutectoid Ferrite, P: Pearlite, B: Bainite, M: Martensite
CE: Comparative Example
IE: Inventive Example
CR to 600° C.: Cooling Rate to 600° C.
CR after 600° C.: Cooling Rate after 600° C.
EP: Equilibrium Phase
ACS: Average Colony Size
AGS: Average Grain Size
AMAS CC: Average Major-Axis Size of Cementite in Colony
D in F-AGS: Deviation in Average Grain Sizes of Proeutectoid Ferrite of Surface Layer Portion and Central Portion
TS: Tensile Strength

TABLE 4

| | Ae1 (° C.) | HTemp (° C.) | HTime (Hr) | CR to 660° C. (° C./Hr) | C-AAR after SHT | TS after SHT (MPa) |
|---|---|---|---|---|---|---|
| CE 1 | 738.4 | 750 | 10 | 30 | 8.5 | 585 |
| CE 2 | 734.8 | 740 | 11 | 20 | 6.2 | 595 |
| CE 3 | 740.2 | 700 | 12 | 15 | 7.5 | 580 |
| CE 4 | 740.2 | 745 | 14 | 25 | 5.5 | 578 |
| IE 1 | 743.6 | 750 | 13 | 15 | 2 | 521 |
| IE 2 | 741.6 | 745 | 12 | 17 | 2.1 | 505 |
| IE 3 | 739.7 | 755 | 13 | 10 | 1.5 | 513 |
| IE 4 | 739.0 | 750 | 15 | 13 | 1.4 | 530 |
| IE 5 | 727.6 | 760 | 14 | 15 | 1.3 | 502 |

CE: Comparative Example
IE: Inventive Example
HTemp: Heating Temperature
HTime: Heating Time
CR to 600° C.: Cooling Rate to 600° C.
CR after 600° C.: Cooling Rate after 600° C.
C-AAR after SHT: Average Aspect Ratio of Cementite after Spheroidizing Heat Treatment
TS after SHT: Tensile Strength after Spheroidizing Heat Treatment As can be seen from Tables 1 to 4, in Inventive Examples 1 to 5 satisfying the alloy composition and manufacturing conditions proposed in the present disclosure, not only the microstructure type and the fraction of the present disclosure but also fine grains were secured, and thus, the average aspect ratio of cementite was less than 2.5 with a spheroidizing heat treatment performed only once.

However, in Comparative Examples 1 to 4 which did not satisfy the alloy composition or manufacturing conditions suggested in the present disclosure, it may be confirmed that the microstructure type and the fraction of the present disclosure were not satisfied or fine grains were not secured, and thus, an average aspect ratio of cementite was relatively high when a spheroidizing heat treatment was performed once. As a result, an additional spheroidization heat treatment may be required to be applied to an end product.

FIG. 1 is an image of a microstructure before finishing hot-rolling in Comparative Example 1, obtained using an optical microscope. FIG. 2 is an image of a microstructure before finishing hot-rolling in Inventive Example 1, obtained using an optical microscope. As can be seen from FIGS. 1 and 2, an AGS before finish hot rolling was relatively fine in Inventive Example 1, as compared with Comparative Example 1.

FIG. 3 is an image of a microstructure after rolling and cooling in Comparative Example 1, in which (a) is an image obtained using an optical microscope and (b) is an image obtained using a scanning electron microscope (SEM). FIG. 4 is an image of a microstructure after rolling and cooling in Inventive Example 1, in which (a) is an image obtained using an optical microscope and (b) is an image obtained using an SEM. As can be seen from FIGS. 3 and 4, a microstructure of Inventive Example 1 after rolling and cooling was fine and cementite was segmented, as compared with Comparative Example 1.

FIG. 5 is an image of a microstructure after a spheroidizing heat treatment in Comparative Example 1, obtained using an SEM. FIG. 6 is an image of a microstructure after a spheroidizing heat treatment in Inventive Example 1, obtained using an SEM. As can be seen from FIGS. 5 and 6, the microstructure of Inventive Example 1 was spheroidized after a spheroidizing heat treatment, as compared with Comparative Example 1.

The invention claimed is:

1. A wire rod allowing a softening heat treatment to be omitted, the wire rod comprising, by weight %, 0.2 to 0.45% of carbon (C), 0.02 to 0.4% of silicon (Si), 0.3 to 1.5% of manganese (Mn), 0.3 to 1.5% of chromium (Cr), 0.02 to 0.05% of aluminum (Al), 0.01 to 0.5% of molybdenum (Mo), 0.01% or less of nitrogen (N), and a balance of iron (Fe) and inevitable impurities, wherein the wire rod has a microstructure consisting of, by area %, 40% or more of proeutectoid ferrite based on an equilibrium phase, 40% or more of regenerated pearlite and bainite, and 20% or less of martensite, and wherein an average colony size of the pearlite in a region from a ⅖ point to a ⅗ point of a diameter, from a surface of the wire rod, is 5 μm or less.

2. The wire rod of claim 1, wherein an average grain size of the proeutectoid ferrite in the region of the ⅖ point to ⅗ point of the diameter, from the surface of the wire rod, is 7 μm or less.

3. The wire rod of claim 1, wherein an average major-axis size of cementite in the pearlite colony is 5 μm or less.

4. The wire rod of claim 1, wherein a deviation between an average grain size of the proeutectoid ferrite in a region from a surface of the wire rod to a ⅕ point of the diameter and an average grain size of the proeutectoid ferrite in the region from the ⅖ point to the ⅗ point of the diameter is 6 μm or less.

5. The wire rod of claim 1, wherein tensile strength is 579+864×([C]+[Si]/8+[Mn]/18) MPa or more.

6. The wire rod of claim 1, wherein an average aspect ratio of cementite after a spheroidizing annealing heat treatment performed once is 2.5 or less.

7. The wire rod of claim 1, wherein tensile strength after a spheroidization heat treatment performed once is 540 MPa or less.

* * * * *